US005552814A

United States Patent [19]

Maeda et al.

[11] Patent Number: 5,552,814

[45] Date of Patent: Sep. 3, 1996

[54] IMAGE RECORDING APPARATUS WHEREIN TONER CARRIER MEMBER AND PARTICLE-FLOW MODULATING ELECTRODE MEMBER ARE HELD IN CONTACT WITH EACH OTHER

[75] Inventors: Masataka Maeda, Konan; Tomoaki Hattori, Nagoya, both of Japan

[73] Assignee: Brother Kogyo Kabushiki Kaisha, Nagoya, Japan

[21] Appl. No.: 112,471

[22] Filed: Aug. 27, 1993

[30] Foreign Application Priority Data

Sep. 1, 1992 [JP] Japan ..... 4-233522
Sep. 24, 1992 [JP] Japan ..... 4-254494

[51] Int. Cl.[6] ..... B41J 2/06

[52] U.S. Cl. ..... 347/55; 347/149

[58] Field of Search ..... 346/159, 155; 347/55, 149

[56] References Cited

U.S. PATENT DOCUMENTS

| | | | |
|---|---|---|---|
| 4,282,303 | 8/1981 | Bergen | 430/120 |
| 4,568,955 | 2/1986 | Hosoya et al. | 347/55 |
| 4,573,061 | 2/1986 | Fujii et al. | 346/153.1 |
| 4,855,757 | 8/1989 | Wiklof et al. | 346/76 PH |
| 4,912,489 | 3/1990 | Schmidlin | 347/55 |
| 5,010,355 | 4/1991 | Hawkins et al. | 347/55 |
| 5,153,611 | 10/1992 | Kokado et al. | 347/55 |
| 5,170,185 | 12/1992 | Takemura et al. | 347/55 |
| 5,200,769 | 4/1993 | Takemura et al. | 347/55 |
| 5,229,794 | 7/1993 | Honma et al. | 347/55 |
| 5,453,768 | 9/1995 | Schmidlin | 347/55 |

FOREIGN PATENT DOCUMENTS

| | | |
|---|---|---|
| 0463743A3 | 1/1992 | European Pat. Off. . |
| 4-191780 | 7/1992 | Japan . |

*Primary Examiner*—Peter S. Wong
*Assistant Examiner*—Randy W. Gibson
*Attorney, Agent, or Firm*—Oliff & Berridge

[57] ABSTRACT

An apparatus for forming an image on a recording medium by deposition of a toner, including a particle-flow modulating electrode member having apertures formed therethrough and control electrodes corresponding to the apertures, a toner supply device including a toner carrier disposed on one of opposite sides of the electrode member, for carrying a layer of the toner to the apertures, and a voltage applying device for applying a controlled voltage to each control electrode, to thereby modulate flows of the toner particles through the apertures toward the recording medium located on the other side of the electrode member. The apparatus includes a device by which corresponding portions of the toner carrier and the particle-flow modulating electrode member which are adjacent to the apertures are biased against each other for contact therebetween.

30 Claims, 7 Drawing Sheets

IMAGE RECORDING APPARATUS WHEREIN TONER CARRIER MEMBER AND PARTICLE-FLOW MODULATING ELECTRODE MEMBER ARE HELD IN CONTACT WITH EACH OTHER

BACKGROUND OF THE INVENTION

1. Field of the Invention

The present invention relates to an image recording apparatus suitable for copying, printing, plotting, facsimile reproduction, and similar applications, and more particularly to a technique for improved recording efficiency, reduced power requirement and enhanced quality of an image reproduced.

2. Discussion of the Related Art

An example of a known image recording apparatus is disclosed in U.S. Pat. No. 3,689,935 to G. L. Pressman et al. This recording apparatus is designed to form an image on a recording medium, by modulating particle flows of a toner through a plurality of apertures formed through a particle flow modulator. The particle flows through the apertures are modulated by applying controlled electric potentials to respective electrodes provided on the particle flow modulator according to image signals. Described in detail, the particle flow modulator includes an insulating layer, a shielding electrode in the form of a continuous conductive layer formed on one of opposite surfaces of the insulating layer, and a segmented conductive layer formed on the other surface of the insulating layer. The segmented conductive layer consists of a plurality of control electrodes which are electrically insulated from each other. The particle flow modulator has at least one row of apertures formed through the insulating layer and the continuous and segmented conductive layers, such that the apertures correspond to the respective control electrodes. The apparatus also includes: voltage applying means for applying selected electric potentials between the shielding electrode and each of the control electrodes; toner supply means for providing a crowd of electrostatically charged toner particles so that flows of the charged toner particles through the individual apertures of the particle flow modulator are modulated by the applied electric potentials; and means for positioning the recording medium in the path of flow of the toner particles and for providing relative translation between the recording medium and the particle flow modulator.

U.S. Pat. No. 4,912,489 refers to U.S. patent applications Ser. Nos. 946937, 926129, 140266 and 926158, which disclose printers of the type in which the particle flow modulator has control electrodes on the side of the recording medium, and a shielding electrode on the side of the toner supply means.

The U.S. Pat. No. 4,912,489 discloses a particle flow modulator having the reversed arrangement. Namely, the modulator has a shielding electrode on the side of the recording medium, and control electrodes on the side of the toner supply means. This Patent teaches an advantage of this type of particle flow modulator, that the control electrodes are roughly four times more effective than in the prior art device of the type indicated above, in repelling the toner in the off state, namely, when image dots are not to be formed. Thus, the control voltage necessary to modulate the flows of the toner particles through the apertures is about one fourth that required in the prior art.

The particle flows through the apertures will cause respective image dots to be formed by the toner particles on the corresponding local spots on the recording medium, while the inhibition of the particle flows through the apertures results in leaving the corresponding local spots non-imaged by the toner. Thus, an image is formed by modulating the particle flows of the toner through the individual apertures of the particle flow modulator.

In the conventional image recording arrangement disclosed in the U.S. Pat. No. 4,912,489, a layer of toner is supplied by a toner conveyor which travels under the row of apertures of the particle flow modulator (printhead structure). When an image signal for a given aperture requires the formation of an image dot, an appropriate imaging potential is applied between the corresponding control electrode and the shield electrode of the particle flow modulator, so that a crowd of the toner particles is passed through the aperture in question. However, when the image signal does not require the formation of an image dot, the potential applied is changed to a non-imaging value for inhibiting the passage of the toner particle through the aperture. In this off state, the crowd of toner particles is moved away from that aperture. Consequently, the density of the toner crowd near the aperture in question is considerably lowered. This is undesirable when the imaging potential is subsequently applied to cause the passage of the toner particles through that aperture. Thus, the response of the toner flows through the apertures to a change in the potential applied to the particle flow modulator is not satisfactory due to the movement of the toner particles away from the apertures when the non-imaging potential is applied.

Further, the known image recording apparatus indicated above more or less suffers from plugging of the apertures with the toner particles which are deposited on the surfaces of the control electrodes due to the effect of the image force. This leads to deteriorated quality of the image reproduced, that is, local failure to form image dots due to the plugged apertures.

The known image recording apparatus has another drawback, which arises from the arrangement for application of an electric potential to control the flows of the charged toner particles. That is, the potential is applied so that an electric field is produced within the aperture. Accordingly, the magnitude of the electric field outside the aperture is considerably small. This means a relatively small force for introducing the toner particles from under the aperture into the interior of the aperture, whereby the amount of toner which passes through the aperture per unit time is accordingly small, leading to a relatively long time required to allow a sufficient amount of toner to pass through the aperture to form an image dot. Thus, the known apparatus suffers from a low image forming speed. In this respect, an increase in the magnitude of the electric field within the aperture in an effort to promote the passage of the toner particles through the aperture would require the voltage applying means to employ expensive drive elements for applying a sufficiently high potential to the control electrodes of the particle flow modulator.

SUMMARY OF THE INVENTION

It is therefore an object of the present invention to provide an image recording apparatus which is operable with improved efficiency of voltage application and economical to manufacture and which assures enhanced quality of a reproduced image and exhibits and sufficiently high image forming speed.

The above object may be achieved according to the principle of the present invention, which provides an image recording apparatus for forming an image on a recording medium by deposition of a toner, the apparatus including (a) a particle-flow modulating electrode member having a plurality of apertures formed therethrough and a plurality of control electrodes corresponding to the apertures, (b) a toner supply device including a toner carrier which is disposed on one of opposite sides of the electrode member and which carries a layer of the toner on an outer surface thereof, and (c) voltage applying means for applying a controlled voltage to each of the plurality of control electrodes, according to image information representative of the image, and thereby modulating flows of particles of the toner through the plurality of apertures toward the recording medium located on the other side of the electrode member, wherein biasing means is provided for biasing corresponding portions of the toner carrier and the particle-flow modulating electrode member against each other, so that these corresponding portions, which are adjacent to the apertures, are held in contact with each other.

In the image recording apparatus, the toner particles which are electrostatically charged are deposited on the outer surface of the toner carrier so as to form a layer of the particles. The toner carrier carries the toner to a position right under the apertures, at which the particle-flow modulating electrode member contacts the toner layer on the toner carrier. When an image signal corresponding to a certain control electrode does not require an image dot to be formed at the corresponding local spot on the recording medium, a predetermined non-imaging potential is applied to the corresponding control electrode, to produce an electric field that causes an electrostatic force to act on the toner particles so that the particles are retained on the surface of the toner carrier. At this time, the toner particles are inhibited from passing through the corresponding aperture, whereby an image dot is not formed on the recording medium positioned in a feed path on one side of the electrode member remote from the toner carrier. However, the toner particles are held adjacent to the open end of the aperture on the side of the toner carrier, that is, retained on the toner carrier such that the toner layer contacts the portion of the control electrode which surrounds the open end of the aperture.

When the image signal requires an image dot to be formed at a local spot on the recording medium, an imaging potential different from the non-imaging potential indicated above is applied to the corresponding control electrode, so as to produce an electric field that causes an electrostatic force to act on the toner particles so that a stream of the toner particles passes through the corresponding aperture, whereby an image dot is formed on the recording medium. Since a crowd of the toner particles having a sufficiently high density is retained on the toner carrier and located adjacent to and just below the corresponding aperture before the imaging potential is applied, as described above, an amount of the toner particles sufficient to form an image dot can be introduced into and passed through the aperture in a relatively short time when the imaging potential is applied. Thus, the mutually contacting relationship of the particle-flow modulating electrode member and the toner carrier according to the present invention assures increased image forming speed and improved response of the toner particle flows to the image signals, namely, to a change in the potential (imaging or non-imaging potential) applied to the control electrode.

The mutual contact between the particle-flow modulating electrode member and the toner carrier via the toner layer means a substantially zero distance or a reduced distance between the toner carrier and the control electrodes, as compared with a distance in the prior art apparatus. Therefore, the efficiency of voltage application to the electrode member is improved, and the operating cost of the apparatus is accordingly lowered. In addition, the application of a relatively low voltage permits the use of inexpensive drive elements for the control electrodes. In this respect, the cost of manufacture of the apparatus is also lowered. Further, the present arrangement assures improved quality of an image produced by the toner particles transferred through the apertures, without the plugging of the apertures with the toner particles which would be deposited on and transferred from the control electrodes as experienced in the prior art.

The particle-flow modulating electrode member preferably comprises an elastic substrate made of an electrically insulating material so that the control electrodes are formed on one of opposite surfaces of the substrate. In this case, the biasing means may include tensioning means for applying a tension to the electrode member so that the electrode member is held elastically curved along a part of the outer surface of the toner carrier such that the electrode member is in pressing contact with the toner carrier. The tensioning means may use suitable means such as a spring member or members for applying a tension to the electrode member in a direction of feed of the recording medium. The toner carrier itself may function as the tensioning means, or cooperate with such spring member or members to function as the tensioning means. More specifically, the toner carrier may comprise a core made of an elastic material, and a metallic film which covers the surface of this elastic core. This toner carrier is positioned relative to the electrode member so that the core of the toner carrier urges the metallic film onto the electrode member, so as to establish a mutually contacting relationship between the metallic film and the electrode member. However, the biasing means may use other mechanisms, such as a mechanism adapted to bias at least one of the electrode member and the toner carrier in the direction toward each other.

According to another preferred form of this invention, the toner carrier includes a carrier electrode, and the voltage applying means comprises a potential control circuit for regulating an electric potential between the carrier electrode and each control electrode, selectively to a first potential that is sufficient to cause a stream of particles of the toner to pass through the aperture corresponding to each control electrode, and a second potential that is insufficient to cause the stream of particles to pass through the corresponding aperture.

In one arrangement of the above form of the invention, the control electrodes are disposed on one of opposite surfaces of an electrically insulating substrate of the particle-flow modulating electrode member on the side of the toner carrier, such that the toner carrier is held in contact with the portions of the control electrodes surrounding the apertures, through the layer of the toner particles deposited on the outer surface of the toner carrier. In this arrangement, the distance between the toner carrier and the control electrodes is substantially zero, whereby the efficiency of potential application between the toner carrier and the control electrodes is considerably improved. Accordingly, the image forming speed is increased to a significant extent, and the image quality is enhanced. To avoid a possibility of short-circuiting between the toner carrier and the control electrodes, a suitable anti-shorting layer may be formed so as to cover the control electrodes and/or the outer surface of the toner carrier. The anti-shorting layer may consist of an electrically insulating layer made of an electrically insulating material such as polyimide. Alternatively, the anti-shorting layer may be a layer made of an electrically resistive material which has an electrical resistance value between 1 KΩ and 1 TΩ. The electrically resistive layer may be made of a mixture of polyimide and graphite. However, the anti-shorting layer is not essential. In this connection, it is noted that the toner layer interposed between the toner carrier and the electrode member prevents the short-circuiting between these members where the toner consists of an electrically insulating material.

When an anti-shorting layer made of an electrically insulating material covers the the control electrodes, this layer also functions as an anti-static layer for preventing electrostatic charging of the substrate of the electrode member. The electrostatic charging of the substrate is undesirable because it tends to cause the toner particles to be transferred toward the recording medium even when the non-imaging potential is applied between the control electrodes and the toner carrier, or alternatively cause difficult transfer of the toner particles when the imaging potential is applied.

When such an electrically insulating anti-shorting layer covers the outer surface of the toner carrier, this layer is also effective to reduce the required voltage to be applied between the control electrodes and the toner carrier to transfer the toner particles toward the recording medium. This reduction in the required voltage appears to be derived from an effect of the anti-shorting layer of reducing the image force which acts on the toner particles, and/or due to the surface condition of the anti-shorting layer which is different from that of the toner carrier per se.

According to an another arrangement of the above form of the invention, the control electrodes may be formed on the surface of the substrate remote from the toner carrier, that is, on the side of the recording medium. In this case, an electric field produced by application of a potential between the control electrodes and the toner carrier will cover not only the interior of the apertures but also the portion of the toner carrier just below the apertures. This arrangement assures sufficiently high image forming efficiency with high image quality, with comparatively reduced potentials applied between the control electrodes and the toner carrier to modulate the flows of the toner particles through the apertures. Consequently, the voltage applying means may use inexpensive drive elements and is available at an accordingly lowered cost.

It is desirable to prevent electrostatic charging of the electrode member, more precisely, the electrically insulating substrate of the electrode member. In this respect, at least one of the opposite surfaces of the substrate is desirably covered by a suitable anti-static layer effective to prevent the electrostatic charging of the substrate. The anti-static layer may consist of an electrically resistive layer as described with respect to the anti-shorting material. When the control electrodes are disposed on the surface of the substrate on the side of the toner carrier, the surface of the substrate on which the control electrodes are formed is preferably covered by the electrically resistive layer. When the control electrodes are disposed on the surface of the substrate on the side of the recording medium, on the other hand, the surface of the substrate on the side of the toner carrier is preferably covered by the electrically resistive layer. The anti-static layer may consist of an electrically conductive layer formed on one of the opposite surfaces of the substrate of the electrode member. However, the anti-static layer is preferably formed of an electrically resistive material, since unlike the electrically conductive antistatic layer, the electrically resistive anti-static layer does not have an effect of shielding an electric field to be produced to transfer the toner particles toward the recording medium.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
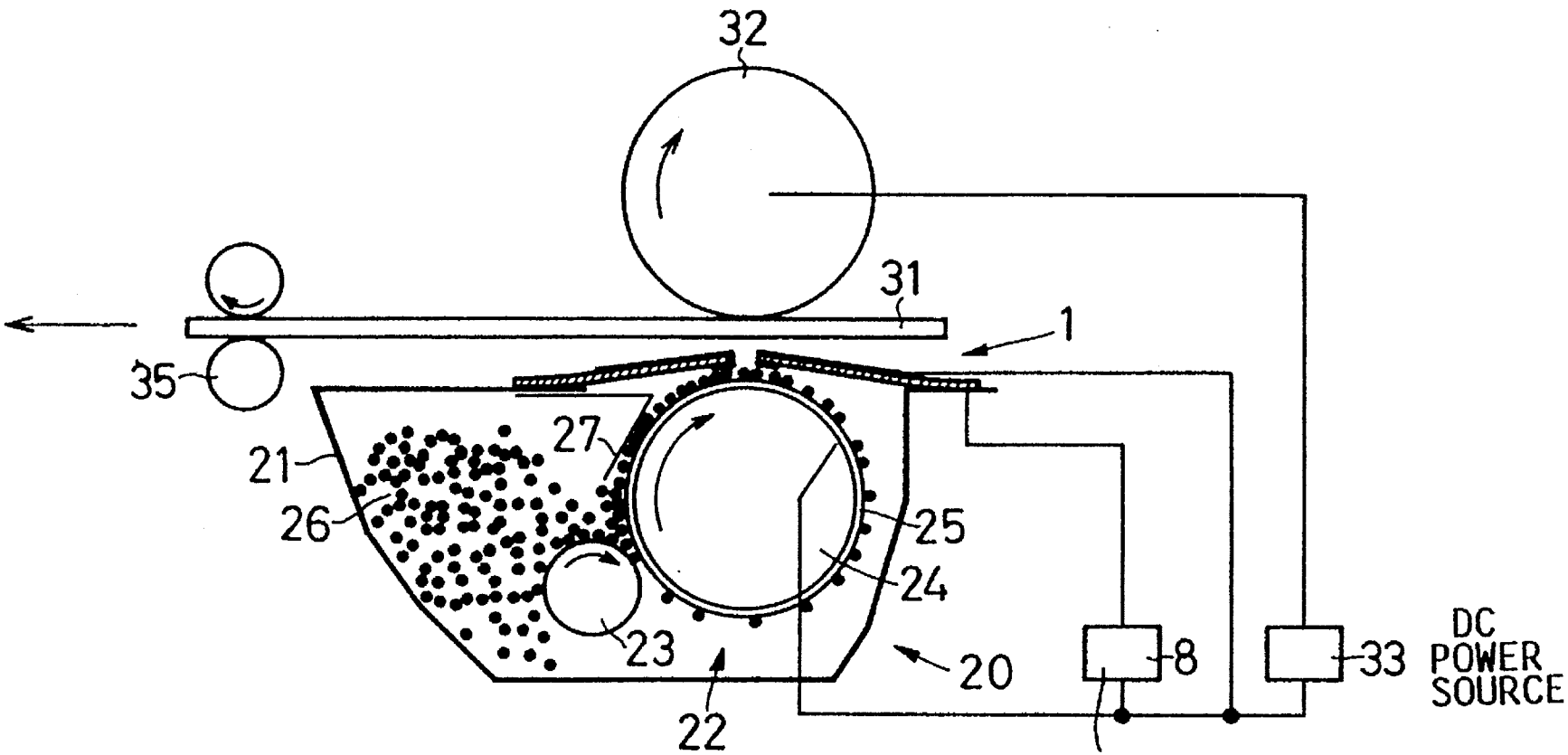
FIG. 1 is a fragmentary schematic view in elevation showing an image recording apparatus constructed according to one embodiment of this invention.
Figure 2:
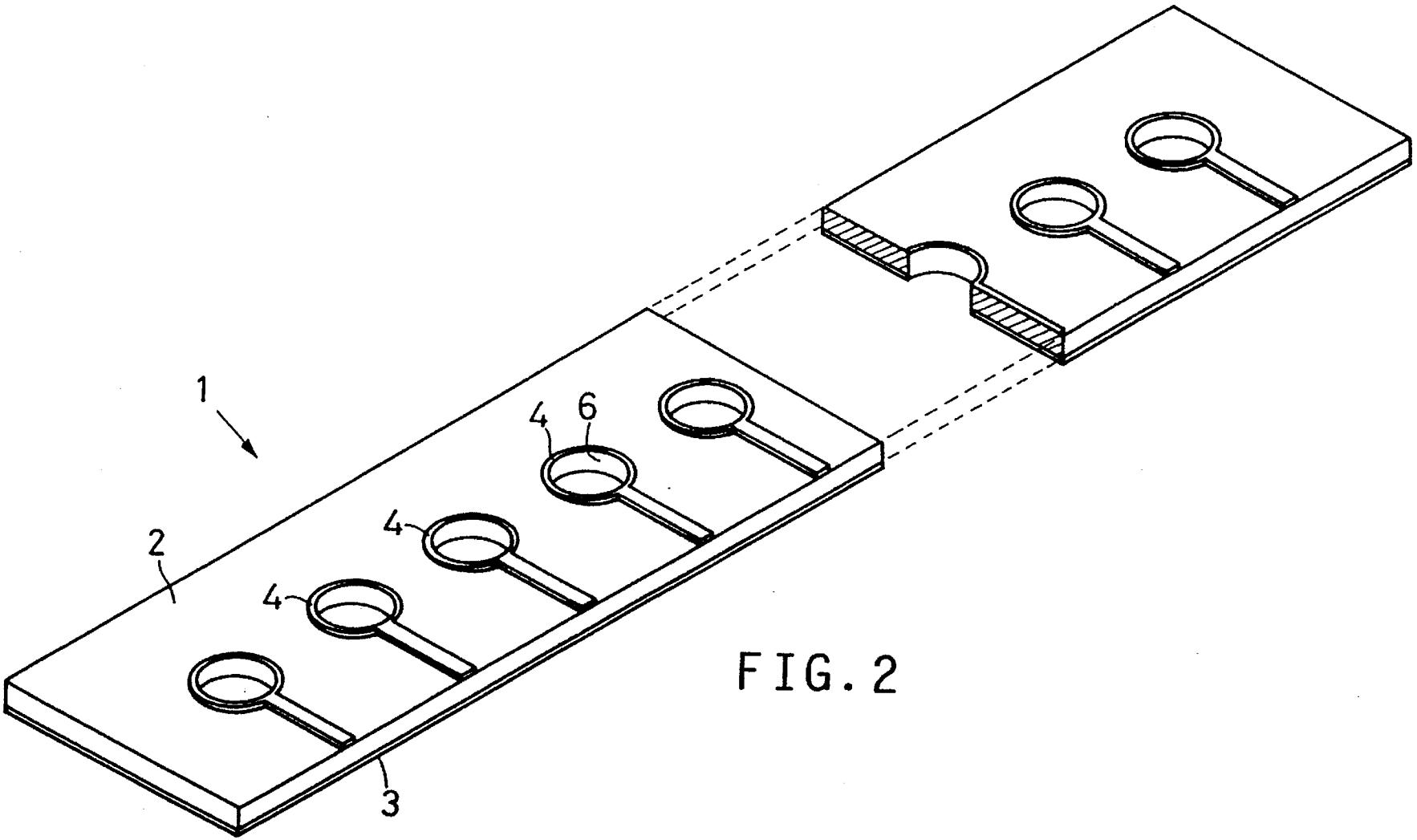
FIG. 2 is a perspective view showing in detail a particle-flow modulating electrode member used in the apparatus of FIG. 1.

Referring first to FIGS. 1 and 2, the image recording apparatus according to the first embodiment of the present invention includes a particle-flow modulating electrode member 1 (hereinafter referred to as "modulating electrode member"), and a back electrode in the form of a roll 32 (hereinafter referred to as "back electrode roll") disposed right above the modulating electrode member 1. The back electrode roll 32 and the modulating electrode member 1 are spaced apart from each other by 1 mm in the vertical direction, and cooperate to partially define a feed path of a recording medium 31 on which an image is formed by deposition of a toner as described below in detail. The back electrode roll 32 is supported rotatably about an axis perpendicular to the feed path of the recording medium 31, so that the medium 31 is fed along the feed path, by rotation of the back electrode roll 32. The feed path extends between a pair of rolls of an image fixing device 35 adapted to fix the toner deposited on the recording medium 31. The apparatus also includes a toner supply device 20 disposed generally below the modulating electrode member 1.

The toner supply device 20 includes a toner casing 21, a toner carrier in the form of a roll 22 (hereinafter referred to as "toner carrier roll"), and a toner feed roll 23. The toner casing 21 is constructed to accommodate a mass of toner 26. The toner carrier roll 22 and the toner feed roll 23 are disposed in parallel with each other and the back electrode roll 32, so as to extend through the interior of the toner casing 21. These rolls 22 and 23 are supported rotatably in the same direction about respective parallel axes, in rolling contact with each other. The rotating directions of the rolls 22, 23 are indicated by arrow in FIG. 1. The toner carrier and feed rolls 22, 23 are positioned so that the contacting circumferential portions of the outer surfaces of these rolls 22, 23 are surrounded by or embedded in the mass of toner 26, and such that the point of rolling contact of the rolls 22, 23 is located a suitable distance above the bottom wall of the toner casing 21.

The toner carrier roll 22 consists of a sponge core 24, and an outer metallic film in the form of a nickel film 25 which covers the circumferential surface of the sponge core 24. The nickel film 25 serves as a carrier electrode which cooperates with the modulating electrode member 1 to modulate flows of the toner particles 26 between the toner carrier 22 and the recording medium 31 through the modulating electrode member 1, as described below in detail. The nickel film 25 has a thickness of 20 μm. The toner carrier roll 22 is held in pressing contact at its nickel film 25 with the modulating electrode member 1 by the elasticity of the sponge core 24.

The toner supply device 20 further has a restrictor blade 27 fixed to the toner casing 21, so that an operating portion of the blade 27 is disposed so as to contact a part of the outer circumference of the toner carrier roll 22, between two points at which the toner carrier roll 22 contacts the toner feed roll 23 and the modulating electrode member 1, respectively. The restrictor blade 27 acts to assure uniform condition of deposition of the toner particles 26 on the outer surface of the toner carrier roll 22, for example, uniform thickness and particle density of the toner layer 26.

In operation of the apparatus, a layer of the toner particles 26 is transferred from the toner feed roll 23 to the toner carrier roll 22, such that the toner layer 26 is interposed between the rolls 22, 23. The toner layer 26 is moved with the rotating carrier roll 22 and is passed while being pressed by the restrictor blade 27 against the circumferential surface of the roll 22.

As shown in enlargement in FIG. 2, the particle-flow modulating electrode member 1 consists of: a 30 μm-thick center substrate 2 made of an elastic, insulating material such as polyimide; a common shielding electrode in the form of a continuous layer 3 made of an electrically conductive material such formed on one of opposite surfaces of the center substrate 2; and a single array of control electrodes 4 which are spaced apart from each other in the direction parallel to the axis of the toner carrier roll 22. The control electrodes 4 are formed of a suitable electrically conductive material such as copper and have a 1 μm thickness. Each control electrode 4 has an annular portion and a straight elongate portion extending from the annular portion. The modulating electrode member 1 has a single row of apertures 6 each having a diameter of 120 μm. The apertures 6 are formed through the center substrate 2 and common shielding electrode 3 and through the annular portions of the respective control electrodes 4. The control electrodes 4 are formed such that the annular portion of each control electrode 4 surrounds the edge of the corresponding aperture 6. The number of the control electrodes 4 and apertures 6 is determined to be sufficient to cover a line of image dots to be formed on the recording medium 31, which line is perpendicular to the direction of feed of the medium 31.

The modulating electrode member 1 is fixed to the toner casing 21 via fixed and movable ceramic bases **7*a* and 7*b*, such that the common shielding electrode 3 is located on the side of the recording medium 31 (that is, on the side of the back electrode roll 32), while the array of control electrodes 4 is located on the side of the toner carrier roll 22. The modulating electrode member 1 is positioned such that the row of aperture 6 is parallel to the axes of the toner carrier roll 22 and back electrode roll 32 and is aligned with a straight line connecting the axes of the rolls 22, 32**.

Figure 3:
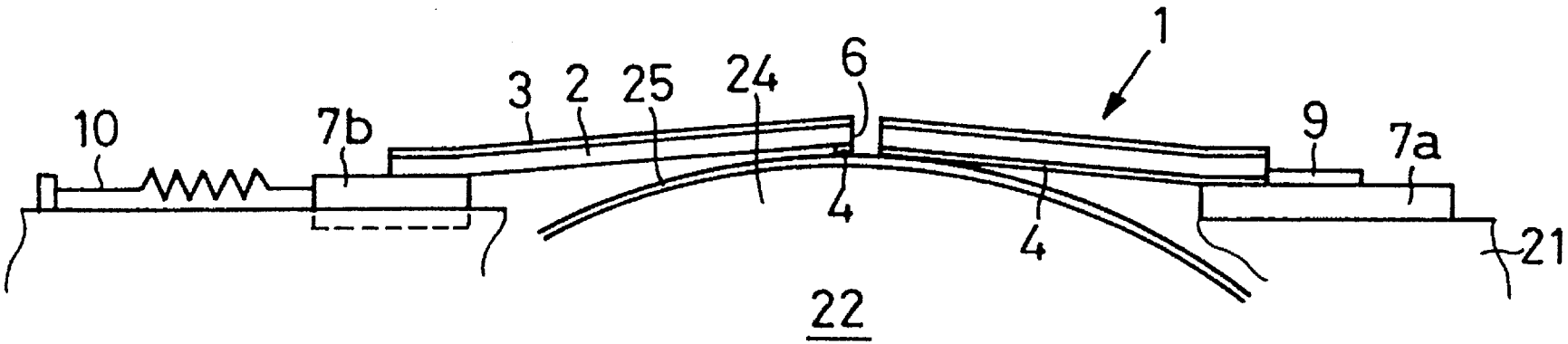
FIG. 3 is a schematic elevational view illustrating a device for biasing the electrode member and a toner carrier roll of the apparatus of FIG. 1 against each other for contact therebetween.

To apply a suitable amount of tension to the modulating electrode member 1, the apparatus incorporates a tensioning device as shown in FIG. 3. The tensioning device is associated with the ceramic bases **7*a*, 7*b* which are secured to the widthwise opposite ends of the modulating electrode member 1. The ceramic base 7*a* on one side of the electrode member 1 is fixed to the toner casing 21, while the movable ceramic base 7*b* on the other side of the electrode member 1 is slidable on the toner casing 21. On the fixed ceramic base 7*a*, there is provided an integrated circuit 9 which is electrically connected to the control electrodes 4, for selectively applying imaging and non-imaging potentials between the control electrodes 4 and the carrier electrode 25. The movable ceramic base 7*b* is connected to a plurality of coil springs 10 which in turn are secured to the toner casing 21. In this arrangement, a total biasing force of the coil springs 10 is applied as a tension to the modulating electrode member 1 in substantially the circumferential direction of the carrier roll 22, which is perpendicular to the axis of the toner carrier roll 22. The coil springs 10 may be replaced by other types of biasing means. The biasing force of the springs 10 may act on the electrode member 1 in either one of the clockwise and counterclockwise direction of the roll 22, as seen in FIG. 3. However, the electrode member 1 is preferably tensioned in the rotating direction of the roll 22**.

The tensioning device **7*a*, 7*b*, 10 indicated above cooperates with the sponge core 24 of the toner carrier roll 22 to provide tensioning means for applying a tension to the electrode member 1 so that the electrode member 1 including the elastic substrate 2 is held elastically curved along an upper part of the outer circumferential surface of the toner carrier roll 22 such that the electrode member 1 and the toner carrier are held in pressing contact with each other. This tensioning means therefore acts as biasing means for biasing the corresponding portions of the electrode member 1 and toner carrier roll 22** against each other for contact therebetween.

The apparatus incorporates a control system operated according to image signals. The control system includes voltage applying means equipped with a potential control circuit 8. This potential control circuit 8 is electrically connected to the integrated circuit 9 and to the carrier electrode (nickel film) 25 of the toner carrier roll 22. The potential control circuit 8 is adapted to regulate, via the integrated circuit 9, an electric potential between each control electrode 4 and the carrier electrode 25, selectively to one of two different potential values, that is, imaging potential of 0 V and non-imaging potential of −30 V, according to the image signals corresponding to the individual control apertures 4. The control system also includes a DC pour source or biasing circuit 33 connected between the back electrode roll 32 and the carrier electrode 25, for applying a biasing voltage between the back electrode roll 32 and the carrier electrode 25 such that the back electrode roll 32 has a positive potential of +2.2 kV. The common shielding electrode 3 is connected to the DC biasing circuit 33.

There will next be described an operation of the present image recording apparatus which has been described above.

In a recording operation of the apparatus, the toner carrier roll 22 and the toner feed roll 23 are rotated in rolling contact with each other in the same direction indicated by arrows in FIG. 1. As a result, a constant volume of the toner 26 is continuously transferred onto the outer circumferential surface of the roll 22, more precisely, onto the circumferential surface of the nickel film 25 that serves as the carrier electrode. Since the toner particles 26 are negatively electrostatically charged, the toner particles 26 are retained in the form of a layer on the nickel carrier electrode 25. The thickness of the toner layer 26 is reduced to a suitable value and made uniform by the restrictor blade 27, before each instantaneous portion of the toner layer 26 in the circumferential direction of the roll 22 reaches the point right below the row of apertures 6 of the modulating electrode member 1, by rotation of the toner carrier roll 22. It is noted that the toner layer 26 has a thickness value of 10 μm, at a portion thereof which passes through the nip between the toner carrier roll 22 and the row of control electrodes 4.

When an image signal for a given control electrode 4 requires the formation of an image dot by passage of a stream of the toner particles 26 through the corresponding aperture 4 of the modulating electrode member 1, the potential control circuit 8 applies the imaging potential of 0 V between the control electrode 4 in question and the carrier electrode 25 of the toner carrier roll 22. In this condition, the negatively charged toner particles 26 on a portion of the roll 22 adjacent to the aperture 4 in question are exposed to an electrostatic force acting in the direction toward the back electrode roll 32, in the presence of a potential difference between the back electrode roll 32 and the carrier electrode 25 on the roll 22, which difference produces a line of electric force in the direction from the back electrode roll 32 toward the carrier electrode 25. Consequently, a stream of the toner particles 26 adjacent to the lower open end of the corresponding aperture 6 is transferred from the carrier electrode 25 toward the back electrode roll 32, while passing through the aperture 6, whereby a given amount of the toner particles 26 is deposited in an area of the recording medium 31 which is aligned with the aperture 6 in question. Thus, an image dot is formed at a local spot of the medium 31, according to the image signal.

When the image signal does not require the formation of an image dot, on the other hand, the potential control circuit 8 applies the non-imaging potential of −30 V between the corresponding control electrode 4 and the carrier electrode 25. In this condition, a line of electric force is produced in the direction from the carrier electrode 25 toward the control electrode 4 in question, in the presence of a potential difference between the control electrode 4 and the carrier electrode 25. Since the potential of the control electrode 4 is smaller than that of the carrier electrode 25, the negatively charged toner particles 26 are retained on the carrier electrode 25 by an electrostatic force. Namely, the toner particles 26 adjacent to the control electrode 4 in question are not transferred to the recording medium 31 through the corresponding aperture 6, and the image signal does not cause an image dot to be formed on the medium 31.

For all the control electrodes 4 arranged in a row on the modulating electrode member 1, the potential is regulated in the manner as described above, by the potential control circuit 8 according to the respective image signals. Thus, a line of image dots parallel to the row of the apertures 4 is formed. During formation of each line of image dots, the recording medium 31 is fed by rotation of the back electrode roll 32, along the feed path (perpendicular to the row of apertures 6), by a predetermined distance which corresponds to the line spacing or the size of each picture element. The formation of image dots and the feeding of the medium 31 are repeated to form successive lines of image dots. A predetermined number of these lines of image dots constitute a line of characters, for example, and successive lines of characters are recorded over a predetermined length of the medium 31 while the medium 31 is continuously fed.

In the present image recording apparatus, a crowd of the toner particles 26 is always present adjacent to each control electrode 4, or right below the lower open end of the corresponding aperture 6. Accordingly, the toner particles 26 can be transferred to the medium 31 with a sufficiently high response to a change in the potential between the control electrode 4 and the carrier electrode 25. Further, these control and carrier electrodes 4 and 25 are positioned very close to each other (with the thin layer of toner particles 26 interposed therebetween), the required magnitude of an electric field produced therebetween can be made relatively small. Thus, the present apparatus does not require expensive drive elements applying the imaging and non-imaging potentials between the control electrodes 4 and the toner carrier electrode 25.

Further, the layer of the negatively charged toner particles 26 is retained on the surface of the carrier electrode 25 and moved in sliding contact with the row of control electrodes 4, the toner particles 26 are unlikely to be deposited on the control electrodes 4 and therefore unlikely to plug the apertures 6. Thus, the present apparatus assures high quality of the image produced.

In the present embodiment, the common shielding electrode 3 is provided on the modulating electrode member 1, for protecting the layer of the toner particles 26 except the portion right below the aperture row 6, against an influence of the electric field produced by the back electrode roll 32. However, the shielding electrode 3 is not essential according to the principle of the present invention.

In the present embodiment, the short-circuiting between the control electrodes 4 and the carrier electrode 25 is prevented by the layer of the toner 26 which is interposed therebetween and which consists of an electrically insulating material.

Figure 4:
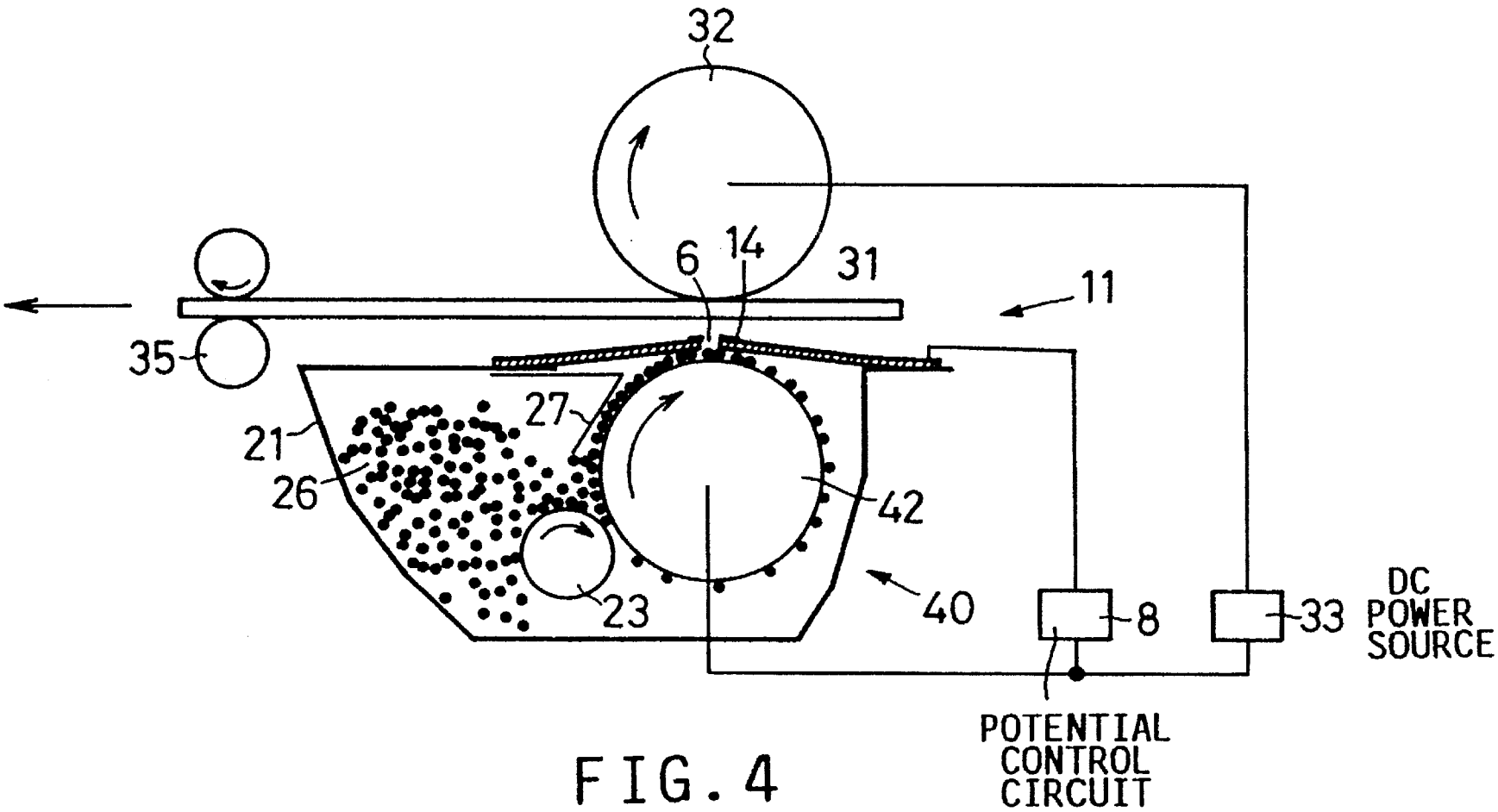
FIG. 4 is a fragmentary schematic view in elevation showing an apparatus according to a second embodiment of the invention.
Figure 5:
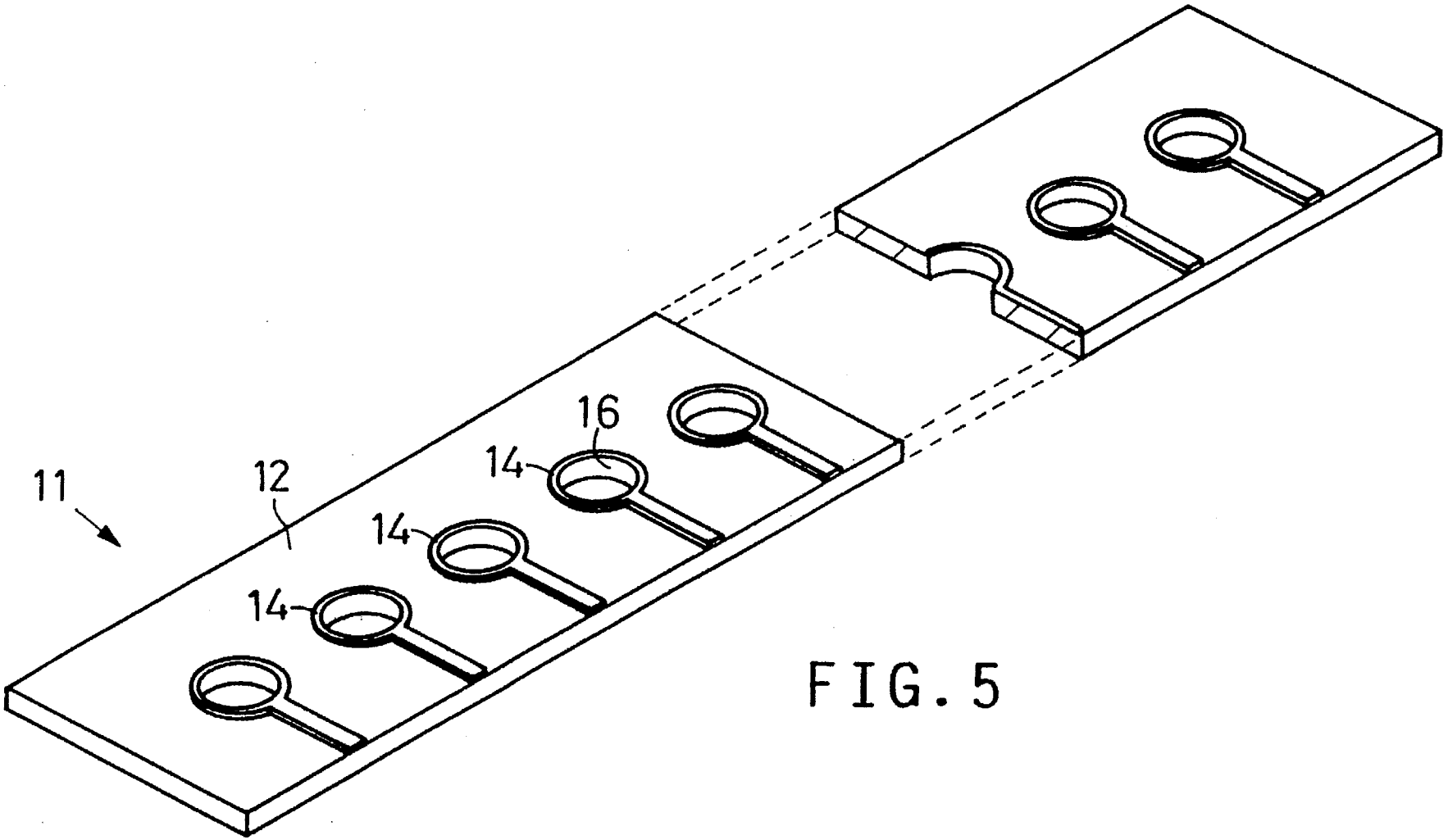
FIG. 5 is a perspective view of the electrode member used in the second embodiment of FIG. 4.

Referring next to FIGS. 4 and 5 corresponding to FIGS. 1 and 2 of the first embodiment, there will be described a second embodiment of this invention. In FIGS. 4 and 5, the same reference numerals as used in FIGS. 1 and 2 are used to identify the same components.

The present second embodiment of FIGS. 4 and 5 uses a toner supply device 40 which is identical with the toner supply device 20 of the first embodiment, except for a toner carrier roll 42 which is entirely made of aluminum. Thus, the entirety of the toner carrier roll 42 serves as a carrier electrode. In addition, the toner feed roll 23 and the restrictor blade 27 are disposed in close proximity to the carrier roll 42. However, the roll 23 and the blade 27 may be biased by suitable means such as springs against the carrier roll 42.

Above the toner carrier roll 42, there is disposed a particle-flow modulating electrode member 11, which is different from the modulating electrode member 1. The electrode member 11 does not have a common shielding electrode. That is, the modulating electrode member 1 consists of a 25 μm thick polyimide substrate 12 and a single row of 1 μm-thick control electrodes 14 on one of opposite surfaces of the substrate 12, as shown in enlargement in FIG. 5. The electrode member 11 has apertures 16 formed through the substrate 12 and the annular portions of the respective control electrodes 14. Each aperture 16 has a diameter of 100 μm.

In the present second embodiment, the modulating electrode member 11 is secured to the toner casing 21 such that the row of control electrodes 14 is located on the side of the recording medium 31 or back electrode roll 32. As in the first embodiment, a suitable tensioning means as illustrated in FIG. 3 is provided to apply a suitable tension to the modulating electrode member 11 so that a portion of the substrate 12 adjacent to the row of apertures 16 is held in contact with the toner carrier roll 42, with the toner layer 26 interposed therebetween.

The potential control circuit 8 is adapted to selectively apply, via the integrated circuit 9 as shown in FIG. 3, different electric potentials, that is, non-imaging potential of 0 V and imaging potential of +50 V, between each control electrode 14 and the toner carrier roll 42 (carrier electrode), according to an image signal. The DC power source or biasing circuit 33 is adapted to apply a biasing voltage between the toner carrier roll 42 and the back electrode roll 32 (i.e., between the carrier electrode 42 and back electrode 32), such that the back electrode roll 32 has a positive potential of +1 kV.

In operation, an image dot is formed when the potential control circuit 8 applies the imaging potential of +50 V between the control electrode 14 and the toner carrier roll 42. In this condition, a potential difference between the control electrode 14 and the toner carrier roll 42 produces a line of electric force in the direction from the control electrode 14 toward the toner carrier roll 42, whereby the negatively electrostatically charged toner particles 26 are exposed to an electrostatic force, which causes the toner particles 26 to be transferred from the surface of the roll 42 toward the control electrode 14 while passing through the corresponding aperture 16. A stream of the toner particles 26 reaching the control electrode 14 is further transferred to the surface of the recording medium 31, in the presence of an electric field produced between the back electrode roll 32 and the control electrode 14. Thus, the toner particles 26 are deposited in an area of the medium 31 which is aligned with the aperture 16 in question, and an image dot is formed in that area, according to the image signal.

When the image signal does not require an image dot to be formed, the potential control circuit 8 applies 0 V between the toner carrier roll 42 and the control electrode 14 in question. Since no electric field is produced between the toner carrier roll 42 and the control electrode 14, a portion of the toner particles 26 on the roll 42 which is adjacent to the control electrode 14 is not exposed to an electrostatic force sufficne to cause the toner particles 26 to be transferred toward the recording medium 31 through the aperture 16.

In the above second embodiment, the non-imaging potential of 0 V is applied between the control electrode 14 and the toner carrier roll 42 when an image dot is not to be formed. However, a negative non-imaging potential may be applied. This negative potential will increase the force of retention of the toner particles 26 on the toner carrier roll 42, which is produced when the image signal does not require the formation of an image dot. Consequently, the corresponding local spot on the recording medium 31 is completely free from the toner particles 26, which might be otherwise more or less transferred from the toner carrier roll 42 even when the image signal inhibits the transfer through the aperture 16. Accordingly, the quality of the image produced is enhanced.

In the present second embodiment, the control electric field is produced between each control electrode 14 and the toner carrier roll 42 which are located on the opposite sides of the corresponding aperture 16. This arrangement assures easy and accurate control of a flow of the toner particles 26 through the aperture 16, and increased speed of movement of the toner particles from the toner carrier roll 42 to the recording medium 31. Further, when the image signal does not require the formation of an image dot, the electric field produced within each aperture 16 according to the image signal effectively prevents the passage of the toner particles 26 through the aperture 16, even if the toner particles 26 are more or less forced into the aperture 16 due to sliding contact of the toner layer 26 with the modulating electrode member 11 under some mechanical force.

Since the distance between the modulating electrode member 1 and the toner carrier roll 42 is substantially zero, namely, the electrode member 1 and the roll 42 are spaced apart from each other by the very small thickness (about 10 μm) of the toner layer 16, the required magnitude of the electric field between the electrode member 11 and the roll 42 can be made relatively small, whereby the apparatus can use relatively inexpensive drive elements for the control electrodes 14.

In the present second embodiment, the row of control electrodes 14 and the toner carrier roll 42 are electrically insulated by the electrically insulating substrate 12 of the modulating electrode member 1. This arrangement is free from short-circuiting or direct electrical contact between the control electrodes 14 and the roll 42, which would take place in the event of discontinuity of the toner layer 16 or local exposure of the outer surface of the roll 42 due to some trouble with the toner supply device 40. Thus, the present apparatus assures high operating reliability and prolonged service life of the control electrodes 4.

Further, the toner layer 16 contacts the electrically insulating substrate 12 of the electrode member 11, the toner particles 26 are unlikely to be deposited on the portion of the electrode member 11 around the apertures 14. Consequently, the apertures 14 are protected against plugging with the toner particles 26 deposited on the electrode member 11.

Referring to FIGS. 6 through 9, there will be described third through sixth embodiments of the present invention, which are modified forms of the first embodiment in which the control electrodes 4 are disposed on the side of the toner carrier roll 22.

Figure 6:
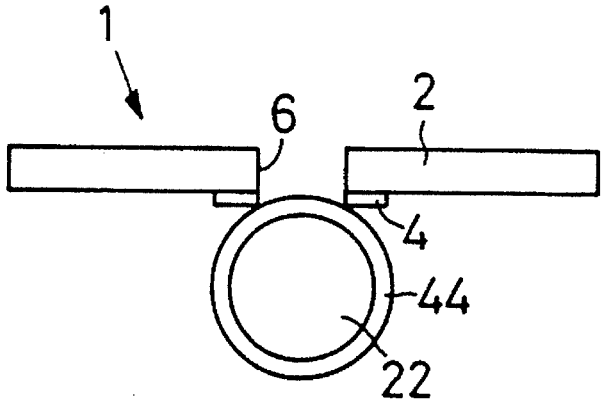
FIGS. 6–9 are schematic views illustrating third, fourth, fifth and sixth embodiments of the invention, which are modifications of the first embodiments of FIG. 1 and 2.

In the third embodiment of FIG. 6, the outer circumferential surface of the toner carrier roll 22 (more precisely, the carrier electrode 25 of the roll 22) is covered by an anti-shorting electrically insulating layer 44 which is made of an electrically insulating material such as polyimide and having a thickness of 10 μm. This anti-shorting layer 44 prevents short-circuiting between the toner carrier roll 22 and the control electrodes 4. Since the required thickness of the anti-shorting layer 44 is small, the provision of this layer 44 would not considerably increase the distance between the carrier electrode 25 and the control electrodes 4. That is, since the carrier roll 22 serves as a backing for the anti-shorting layer 44, the thickness of the layer 44 can be made considerably smaller than that of the substrate 2, whereby the distance between the carrier roll 22 and the control electrodes 4 is shorter than the distance between the carrier roll 42 and the control electrodes 14 in the second embodiment of FIGS. 4 and 5.

Figure 7:
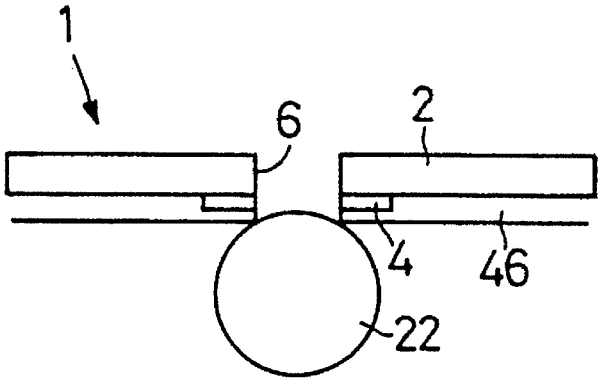

In the fourth embodiment of FIG. 7, the control electrodes 4 are covered by an anti-shorting electrically insulating layer 46 made of an electrically insulating material like the layer 44 of FIG. 6. This anti-shorting layer 46 prevents short-circuiting between the toner carrier roll 22 and the control electrodes 4. While only the control electrodes 4 may be covered by the anti-shorting layer 46, the entire lower surface of the substrate 2 of the electrode member 1 is preferably covered by the anti-shorting 46 as indicated in FIG. 7, so that the electrode member 1 has a flat or straight lower surface, without downward projection of the control electrodes 14. This arrangement is desirable for smooth movement of the toner particles in sliding or rolling contact with the portion of the lower surface of the electrode member 1 near the row of apertures 6.

Figure 8:
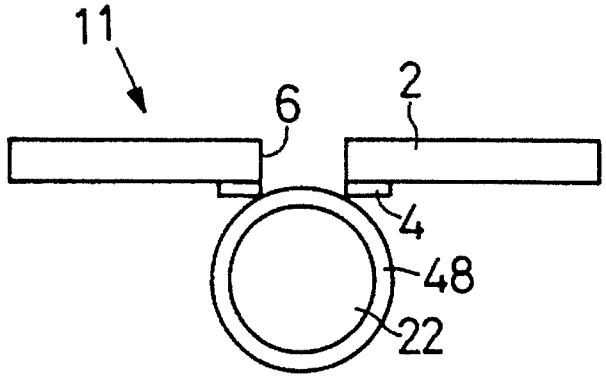

In the fifth embodiment of FIG. 8, the toner carrier roll 22 is covered by an electrically resistive layer 48 made of a material which has a high electric resistivity value of between 1 KΩ and 10 TΩ. The electrically resistive layer 48 preferably has a thickness between 5–10 μm, and may be made of a mixture of polyimide and graphite. For instance, the layer 48 made of a mixture consisting of 30 parts by weight of SP1-200N as polyimide available from Shinnittetsu Kagaku (Japan) and 1 part by weight of Ketjen Black as graphite available from Lion Akzo (Japan) has surface electrical resistivity of 6.8 GΩ, and the layer 48 made of a mixture consisting of 10 parts by weight of SP1-200N identified above and 1 part by weight of HOP as graphite available from Nippon Kokuen (Japan) has surface electrical resistivity of 1.4 TΩ. The electrically resistive layer 48 functions as an anti-shorting layer for preventing short-circuiting between the toner carrier roll 22 and the control electrodes 22. Further, the layer 48 is effective to reduce the force by which the toner particles are retained on the carrier roll 22, and is therefore effective to reduce the required potential to transfer the toner particles from the carrier roll 22 toward the recording medium. This reduction of the toner retention force is supposed to be derived from an effect of the layer 48 of reducing the image force which acts on the toner particles, and appears to depend on the surface condition of the layer 48 which is different from that of the carrier roll 22.

Figure 9:
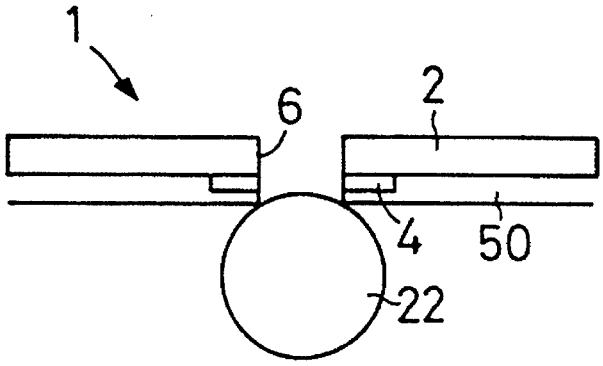

In the sixth embodiment of FIG. 9, the control electrodes 4 and the lower surface of the substrate 2 of the modulating electrode member 1 are covered by an electrically resistive layer 50 made of a material similar to that of the layer 48 of FIG. 8. The layer 50 gives the electrode member 1 a constant thickness over the entire width and a straight lower surface, which assures smooth movement of the toner layer 26 toward the lower open end of the apertures 6. This electrically resistive layer 50 functions not only as an anti-shorting layer for preventing short-circuiting between the toner carrier roll 22 and the control electrodes 4, but also as an anti-static layer for preventing electrostatic charging of the insulating substrate 2 of the electrode member 1. Further, since the layer 50 is electrostatically equivalent to the electrodes 4, the layer 50 does not increase the distance between the carrier roll 22 and the electrodes 22.

Figure 10:
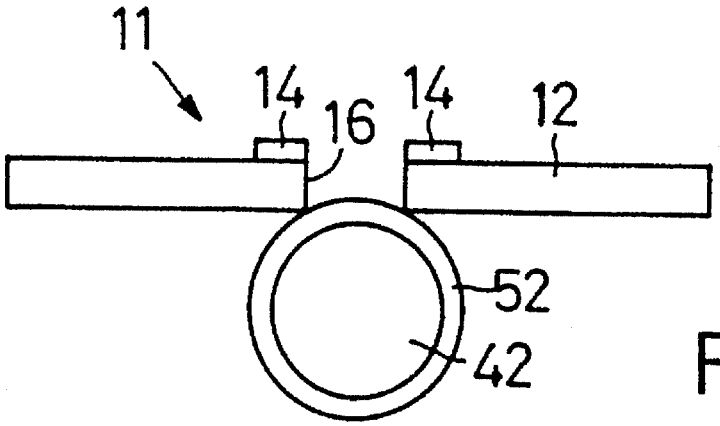
FIGS. 10 and 11 are schematic views illustrating seventh and eighth embodiments of the invention, which are modifications of the second embodiment of FIGS. 4 and 5.
Figure 11:
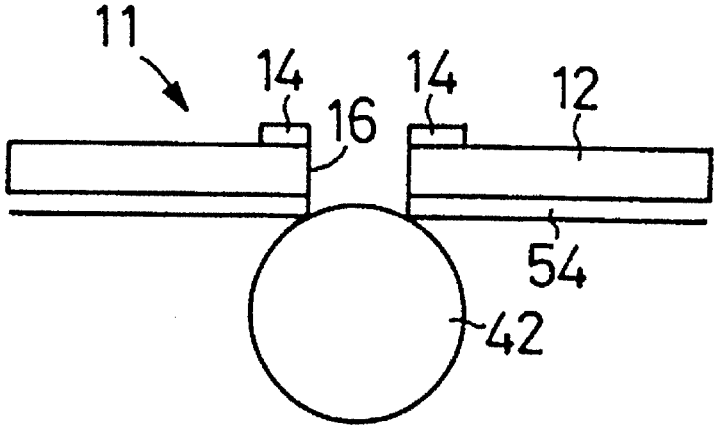

Referring to FIGS. 10 and 11, there will be described seventh and eighth embodiments of this invention, which are modified forms of the second embodiment of FIGS. 4 and 5 in which the control electrodes 14 are formed on the side of the recording medium 31, or on the side remote from the toner carrier roll 42.

In the seventh embodiment of FIG. 10, the outer circumferential surface of the toner carrier roll 42 is covered by an electrically resistive layer 52 similar to the layer 48 of FIG. 8. This layer 52 serves as an anti-shorting layer for preventing short-circuiting between the toner carrier roll 42 and the control electrodes 14, which may occur due to penetration of the material of the electrodes 14 through the apertures 16 when the apertures 16 are formed. Described in detail, the apertures 16 are formed by application of a laser beam through the annular portions of the control electrodes 14 and the insulating substrate 12. At this time, the material such as copper of the electrodes 14 may partially flow into the formed apertures 16 and remain on the inner surfaces of the apertures 16 and around the lower edge of the apertures 16. This may cause short-circuiting between the toner carrier roll 42 and the control electrodes 14.

The layer 52 may be relaced by an electrically insulating layer similar to the layer 44 of FIG. 6.

In the eighth embodiment of FIG. 11, the entire lower surface of the substrate 12 of the modulating electrode member 11 is covered by an electrically resistive layer 54 similar to the layer 50 of FIG. 9. This layer 54 serves as an anti-static layer for preventing electrostatic charging of the insulating substrate 12 of the electrode member 11. Although the electrically resistive layer 54 may be replaced by an electrically conductive layer to prevent the electrostatic charging of the substrate 12, the electrically resistive anti-static layer is preferred since the electrically conductive anti-static layer undesirably has an effect of shielding an electric field produced to transfer the toner particles toward the recording medium.

Figure 12:
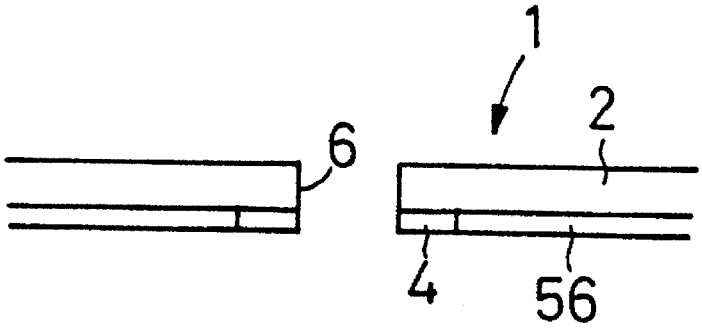
FIG. 12 is a schematic views illustrating a modified form of the sixth embodiment of FIG. 9.

Referring to FIG. 12, there is shown one form of modification of the sixth embodiment of FIG. 9. In this modified form of FIG. 12, an electrically resistive layer 56 covers only the exposed portion of the lower surface of the insulating substrate 2 of the electrode member 1. Namely, the control electrodes 4 provided on the lower surface of the substrate 2 of the electrode member 1 are not covered by the electrically resistive layer 56. The thickness of the layer 56 is selected to be equal to that of the control electrodes 4 so that the electrode member 1 has a constant thickness and a straight lower surface over the entire width. The layer 56 serves only as an anti-static layer for preventing electrostatic charging of the substrate 2.

While the present invention has been described in its presently preferred embodiments for illustrative purpose only, it is to be understood that the present invention is not limited to the details of the illustrated embodiments, but may be otherwise embodied with various changes, modifications and improvements, which may occur to those skilled in the art, without departing from the spirit and scope of the invention defined in the following claims.

What is claimed is:

1. An image recording apparatus for forming an image on a recording medium by deposition of a toner, said apparatus including (a) a particle-flow modulating electrode member having a plurality of apertures formed therethrough and a plurality of control electrodes corresponding to said apertures, (b) a toner supply device including a toner carrier which is disposed on one of opposite sides of said electrode member and which carries a layer of said toner on an outer surface thereof, and (c) voltage applying means for applying a controlled voltage to each of said plurality of control electrodes, according to image information representative of said image, and thereby modulating flows of particles of said toner through said plurality of apertures toward said recording medium located on the other side of said electrode member, said apparatus comprising:

a biasing device for biasing corresponding portions of said toner carrier and said particle-flow modulating electrode member against each other for ensuring contact therebetween, said corresponding portions being adjacent to said plurality of apertures.

2. An image recording apparatus according to claim 1, wherein said toner carrier includes a carrier electrode, and said voltage applying means comprises a potential control circuit for regulating an electric potential between said carrier electrode and each of said control electrodes, selectively to a first potential that is sufficient to cause a stream of particles of said toner to pass through the aperture corresponding to said each control electrode, and a second potential that is insufficient to cause said stream of particles to pass through the corresponding aperture.

3. An image recording apparatus according to claim 2, wherein said particle-flow modulating electrode member includes a substrate made of an electrically insulating material, and said plurality of control electrodes are formed on one of opposite surfaces of said substrate on the side of said toner carrier, such that said each control electrode surrounds an edge of said corresponding aperture.

4. An image recording apparatus according to claim 2, wherein at least one of an array of said control electrodes and said toner carrier is covered by an anti-shorting layer for preventing short-circuiting between said control electrodes and said toner carrier.

5. An image recording apparatus according to claim 3, wherein said anti-shorting layer consists of an electrically insulating layer.

6. An image recording apparatus according to claim 4, wherein said anti-shorting layer consists of an electrically resistive layer having an electrical resistance value between 1 KΩ and 1 TΩ.

7. An image recording apparatus according to claim 2, wherein said toner carrier includes a carrier electrode, said apparatus further comprising a back electrode disposed so as to support said recording medium at one of opposite sides of said recording medium remote from said particle-flow modulating electrode member, and a biasing circuit for applying a biasing voltage between said carrier electrode and said back electrode such that said back electrode has a positive potential.

8. An image recording apparatus according to claim 7, wherein said particle-flow modulating electrode member further includes a shielding electrode formed on one of opposite surfaces of said substrate remote from said plurality of control electrodes, said apparatus further comprising a connecting circuit for connecting said carrier electrode and said shielding electrode.

9. An image recording apparatus according to claim 7, wherein said potential control circuit regulates said electric potential between said carrier electrode and said each control electrode, such that a potential of said each control electrode is changeable between a value equal to that of said carrier electrode and a value lower than that of said carrier electrode.

10. An image recording apparatus according to claim 2, wherein said particle-flow modulating electrode member includes a substrate made of an electrically insulating material, and said plurality of control electrodes are formed on one of opposite surfaces of said substrate on the side of said recording medium, such that said each control electrode surrounds an edge of said corresponding aperture.

11. An image recording apparatus according to claim 10, wherein at least one of said toner carrier and said substrate is covered by an electrically resistive layer.

12. An image recording apparatus according to claim 11, wherein said electrically resistive layer has an electrical resistance value between 1 KΩ and 1 TΩ.

13. An image recording apparatus according to claim 10, wherein said toner carrier includes a carrier electrode, said apparatus further comprising a back electrode disposed so as to support said recording medium at one of opposite sides of said recording medium remote from said particle-flow modulating electrode member, and a biasing circuit for applying a biasing voltage between said carrier electrode and said back electrode such that said back electrode has a positive potential.

14. An image recording apparatus according to claim 13, wherein said potential control circuit regulates said electric potential between said carrier electrode and said each control electrode, such that a potential of said each control electrode is changeable between a value not higher than that of said carrier electrode and a value higher than that of said carrier electrode.

15. An image recording apparatus according to claim 1, wherein said particle-flow modulating electrode member comprises a substrate made of an electrically insulating material and having said plurality of apertures, a common electrode provided on one of opposite surfaces of said substrate and in the form of a continuous layer common to all of said plurality of apertures, and said plurality of control electrodes which correspond to said apertures, respectively, and wherein said voltage applying means regulates an electric potential between said common electrode and each of said control electrodes, selectively to a first potential that is sufficient to cause a stream of particles of said toner to pass through the aperture corresponding to said each control electrode, and a second potential that is insufficient to cause said stream of particles to pass through the corresponding aperture.

16. An image recording apparatus according to claim 1, wherein said toner carrier consists of a toner carrier roll which is supported rotatably about an axis thereof, at least an outer portion of said roll which provides an outer surface of said roll being formed of an electrically conductive material and serving as an electrode.

17. An image recording apparatus according to claim 16, wherein said toner supply device comprises said toner carrier roll, and a toner feed roll supported rotatably about an axis parallel to said axis of said toner carrier roll, in the same direction as said toner carrier roll, in substantial contact with said toner carrier roll, said toner supply device further comprising a toner casing which accommodates a mass of said toner such that said mass of toner accommodated in said toner casing surrounds at least mating circumferential portions of outer surfaces of said toner carrier and feed rolls, said toner casing having a bottom lower than said mating portions of said toner carrier and feed rolls.

18. An image recording apparatus according to claim 17, wherein said toner supply device further comprises a restrictor blade disposed along and adjacent to a part of an outer circumference of said toner carrier roll, between two points at which said toner carrier roll is nearest to said toner feed roll and said particle-flow modulating electrode member, so that said restrictor blade contacts a layer of particles of said toner transferred from said toner feed roll to said toner carrier roll, and thereby assures a uniform condition of deposition of the particles of said toner on said outer surface of said toner carrier roll.

19. An image recording apparatus according to claim 18, further comprising second biasing means for biasing said restrictor blade and said outer surface of said toner carrier roll toward each other.

20. An image recording apparatus according to claim 1, further comprising a back electrode roll disposed for rolling contact with one of opposite surfaces of said recording medium remote from said particle-flow modulating electrode member, said back electrode roll serving as an electrode at least at an outer portion thereof which has an outer surface for rolling contact with said one surface of said recording medium.

21. An image recording apparatus according to claim 1, wherein said particle-flow modulating electrode member includes a substrate made of an electrically insulating material, and wherein at least one of opposite surfaces of said substrate is covered by an anti-static layer for preventing electrostatic charging of said substrate.

22. An image recording apparatus according to claim 21, wherein said anti-static layer consists of an electrically resistive layer which has an electrical resistance between 1 KΩ and 1 TΩ.

23. An image recording apparatus according to claim 22, wherein said control electrodes are disposed on one of said opposite surfaces of said substrate of said electrode member on the side of said toner carrier, and wherein said electrically resistive layer covers said one of said opposite surfaces of said substrate.

24. An image recording apparatus according to claim 22, wherein said control electrodes are disposed on one of said opposite surfaces of said substrate of said electrode member on the side of said recording medium, and wherein said electrically resistive layer covers the other of said opposite surfaces of said substrate which is on the side of said toner carrier.

25. An image recording apparatus according to claim 21, wherein said anti-static layer consists of an electrically conductive layer which covers one of said opposite surfaces of said substrate.

26. An image recording apparatus for forming an image on a recording medium by deposition of a toner, said apparatus including (a) a particle-flow modulating electrode member having a plurality of apertures formed therethrough and a plurality of control electrodes corresponding to said apertures, (b) a toner supply device including a toner carrier which is disposed on one of opposite sides of said electrode member and which carries a layer of said toner on an outer surface thereof, and (c) voltage applying means for applying a controlled voltage to each of said plurality of control electrodes, according to image information representative of said image, and thereby modulating flows of particles of said toner through said plurality of apertures toward said recording medium located on the other side of said electrode member, wherein the image recording apparatus comprises:

said toner carrier including a carrier electrode, and said voltage applying means comprising a potential control circuit for regulating an electric potential between said carrier electrode and each of said control electrodes, selectively to a first potential sufficient to cause a stream of particles of said toner to pass through the aperture corresponding to said each control electrode, and a second potential that is insufficient to cause said stream of particles to pass through the corresponding aperture;

said particle-flow modulating electrode member including a substrate having elasticity and made of an electrically insulating material, and said plurality of control electrodes being formed on one of opposite surfaces of said substrate on the side of said toner carrier, such that said each control electrode surrounds an edge of said corresponding aperture;

an anti-shorting layer covering at least one of an array of said control electrodes and said toner carrier, for preventing short-circuiting between said control electrodes and said toner carrier; and a biasing device for biasing corresponding portions of said toner carrier and said particle-flow modulating electrode member against each other for contact therebetween, said corresponding portions being adjacent to said plurality of apertures.

27. An image recording apparatus for forming an image on a recording medium by deposition of a toner, said apparatus including (a) a particle-flow modulating electrode member having a plurality of apertures formed therethrough and a plurality of control electrodes corresponding to said apertures, (b) a toner supply device including a toner carrier which is disposed on one of opposite sides of said electrode member and which carries a layer of said toner on an outer surface thereof, and (c) voltage applying means for applying a controlled voltage to each of said plurality of control electrodes, according to image information representative of said image through said plurality of apertures toward said recording medium located on the other side of said electrode member, wherein the image recording apparatus comprises:

said particle-flow modulating electrode member including a substrate having elasticity and made of an electrically insulating material;

an anti-static layer covering at least one of opposite surfaces of said substrate, for preventing electrostatic charging of said substrate; and a biasing device for biasing corresponding portions of said toner carrier and said particle-flow modulating electrode member against each other for contact therebetween, said corresponding portions being adjacent to said plurality of apertures.

28. An image recording apparatus for forming an image on a recording medium by deposition of a toner, said apparatus including:

a particle-flow modulating electrode member having a plurality of apertures formed therethrough and a plurality of control electrodes corresponding to said apertures, said particle-flow modulating electrode member comprises a substrate having elasticity and made of an electrically insulating material;

a toner supply device including a toner carrier which is disposed on one of opposite sides of said electrode member and which carries a layer of said toner on an outer surface thereof;

voltage applying means for applying a controlled voltage to each of said plurality of control electrodes, according to image information representative of said image, and thereby modulating flows of particles of said toner through said plurality of apertures toward said recording medium located on the other side of said electrode member; and a biasing device for biasing corresponding portions of said toner carrier and said particle-flow modulating electrode member against each other for contact therebetween, said corresponding portions being adjacent to said plurality of apertures, said biasing device including tensioning means for applying a tension to said electrode member so that said electrode member is held elastically curved along a part of said outer surface of said toner carrier such that said electrode member is in pressing contact with said toner carrier.

29. An image recording apparatus according to claim 28, wherein said tensioning means comprises means for applying a tension to said electrode member in a direction of feed of said recording medium.

30. An image recording apparatus according to claim 28, wherein said toner carrier comprises a core made of an elastic material and a metallic film which covers a surface of said core, said toner carrier being positioned relative to said electrode member so that said core presses said metallic film onto said electrode member.

* * * * *